US008434458B2

(12) United States Patent
Asari et al.

(10) Patent No.: US 8,434,458 B2
(45) Date of Patent: May 7, 2013

(54) TIMING TRANSMISSION MECHANISM IN ENGINE

(75) Inventors: Masaru Asari, Wako (JP); Naoto Hirayama, Wako (JP); Aritoshi Imazato, Wako (JP); Kentaro Yamada, Wako (JP); Takeya Harada, Wako (JP); Yoshihiro Fujiyoshi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 474 days.

(21) Appl. No.: 12/867,184

(22) PCT Filed: Feb. 25, 2009

(86) PCT No.: PCT/JP2009/053421

§ 371 (c)(1),
(2), (4) Date: Aug. 11, 2010

(87) PCT Pub. No.: WO2009/107668

PCT Pub. Date: Sep. 3, 2009

(65) Prior Publication Data

US 2011/0005500 A1 Jan. 13, 2011

(30) Foreign Application Priority Data

Feb. 28, 2008 (JP) ..... 2008-048737

(51) Int. Cl.
*F02M 37/04* (2006.01)
*F01L 1/02* (2006.01)

(52) U.S. Cl.
USPC ..... 123/508; 123/90.31

(58) Field of Classification Search ..... 123/508, 123/509, 198 C, 90.27, 90.31
See application file for complete search history.

(56) References Cited

U.S. PATENT DOCUMENTS

| | | | | | |
|---|---|---|---|---|---|
| 4,054,108 | A | * | 10/1977 | Gill | 123/54.4 |
| 4,129,043 | A | * | 12/1978 | Ishikawa | 123/198 R |
| 4,615,308 | A | * | 10/1986 | Asanomi et al. | 123/90.27 |
| 5,678,516 | A | * | 10/1997 | Sakurai | 123/198 R |
| 5,899,181 | A | * | 5/1999 | Kurata et al. | 123/90.17 |
| 6,082,336 | A | * | 7/2000 | Takahashi et al. | 123/508 |
| 6,953,015 | B2 | * | 10/2005 | Asari et al. | 123/90.27 |
| 7,070,526 | B2 | * | 7/2006 | Lawrence | 474/87 |
| 7,753,020 | B2 | * | 7/2010 | Uuzzie et al. | 123/90.31 |
| 7,765,989 | B2 | * | 8/2010 | Maruyama | 123/508 |
| 2006/0201465 | A1 | * | 9/2006 | Stone | 123/90.31 |
| 2007/0227509 | A1 | * | 10/2007 | Ueda et al. | 123/509 |
| 2010/0242872 | A1 | * | 9/2010 | Sato et al. | 123/54.4 |

FOREIGN PATENT DOCUMENTS

| | | | |
|---|---|---|---|
| DE | 80 08 859 | U1 | 12/1986 |
| JP | 6-066111 | A | 3/1994 |
| JP | 10-227225 | A | 8/1998 |
| JP | 2000-008987 | A | 1/2000 |
| JP | 2005-264794 | A | 9/2005 |
| JP | 2006-291715 | A | 10/2006 |

* cited by examiner

*Primary Examiner* — Thomas Moulis
(74) *Attorney, Agent, or Firm* — Arent Fox LLP

(57) ABSTRACT

A timing transmission mechanism (T2) in an engine is formed of a chain transmission system (C) that is formed from a drive sprocket (20) mounted on a crankshaft (4), a driven sprocket (25) mounted on a pump input shaft (24) of a high pressure fuel pump (P), and a chain (22) wound around the drive sprocket (20) and the driven sprocket (25); and a gear transmission system (G) that is formed from a drive gear (26) mounted on the pump input shaft (24) coaxially with the driven sprocket (25) and a driven gear (27) mounted on a camshaft (13*b*) and meshing with the drive gear (26). This enables a timing transmission mechanism to be provided that can increase the degree of freedom in layout of the high pressure fuel pump without causing any increase in the number of components, the weight, or the backlash.

3 Claims, 3 Drawing Sheets

TIMING TRANSMISSION MECHANISM IN ENGINE

TECHNICAL FIELD

The present invention relates to an improvement of a timing transmission mechanism in an engine, the timing transmission mechanism being for driving, by means of a crankshaft, a valve operating camshaft with predetermined timing and a high pressure fuel pump.

BACKGROUND ART

Conventionally, as such a timing transmission mechanism in an engine, an arrangement formed from a gear transmission system that transmits power from a crankshaft to a high pressure fuel pump and a chain transmission system that transmits power from the high pressure fuel pump to a camshaft is known (ref. Patent Document 1).

Patent Document 1: Japanese Patent Application Laid-open No. 2005-264794

DISCLOSURE OF INVENTION

Problems to be Solved by the Invention

In the arrangement described in Patent Document 1 above, although the degree of freedom in layout of the high pressure fuel pump is increased by providing a large-diameter intermediate gear in the gear transmission system so as to greatly widen the interaxial distance between the crankshaft and the high pressure fuel pump, providing the intermediate gear in the gear transmission system not only causes an increase in the number of components and in the weight but also doubles the backlash of the gear transmission system due to the presence of the intermediate gear, thus causing deviation in the transmission timing between the crankshaft and the camshaft or causing vibration.

The present invention has been accomplished in light of such circumstances, and it is an object thereof to provide a timing transmission mechanism in an engine that enables the degree of freedom in layout of a high pressure fuel pump to be increased without causing any increase in the number of components, the weight, or the backlash.

MEANS FOR SOLVING THE PROBLEMS

In order to attain the above object, according to a first aspect of the present invention, there is provided a timing transmission mechanism in an engine, the timing transmission mechanism being for driving, by means of a crankshaft, a valve operating camshaft with predetermined timing and a high pressure fuel pump, characterized in that the timing transmission mechanism comprises a chain transmission system formed from a drive sprocket mounted on the crankshaft, a driven sprocket mounted on a pump input shaft of the high pressure fuel pump, which is disposed on one side of an engine main body where the drive sprocket is present, and a chain wound around the drive sprocket and the driven sprocket; and a gear transmission system formed from a drive gear mounted on the pump input shaft coaxially with the driven sprocket and a driven gear mounted on the camshaft and meshing with the drive gear. The timing transmission mechanism corresponds to a second timing transmission mechanism T2 in an embodiment of the present invention, which is described later.

Further, according to a second aspect of the present invention, in addition to the first aspect, the chain transmission system and the gear transmission system are both disposed on one side of the engine main body, which supports the crankshaft and the camshaft, the gear transmission system is disposed between the engine main body and the chain transmission system, and the high pressure fuel pump is mounted on a pump support member that is fixed to the engine main body so as to be adjacent to an outside face of the chain transmission system. The pump support member corresponds to a transmission cover 30 in the embodiment of the present invention, which is described later.

Moreover, according to a third aspect of the present invention, in addition to the first or second aspect, the high pressure fuel pump is disposed offset toward one side of a plane that connects axes of the crankshaft and the camshaft.

EFFECTS OF THE INVENTION

In accordance with the first aspect of the present invention, in the timing transmission mechanism, since rotation of the crankshaft is transmitted first to the high pressure fuel pump via the chain transmission system and then to the camshaft via the gear transmission system, it is possible to prevent the load for the high pressure fuel pump from being imposed on the camshaft, thus enabling thinning and a reduction in weight of the gear transmission system and the camshaft to be achieved.

Moreover, since the gear transmission system is formed from a double gear, that is, the drive gear and the driven gear mounted on the pump input shaft and the camshaft respectively, not only is the number of components small and the structure simple, but it is also possible to minimize backlash occurring in the timing transmission mechanism, thus maintaining appropriate transmission timing from the crankshaft to the camshaft.

Furthermore, the camshaft is subjected to variation in load due to the valve operating action, and since the variation in load is absorbed via the gear transmission system by the high pressure fuel pump, which has a high load, it is possible to prevent the variation in load for the camshaft from being imposed on the chain transmission system, thus correspondingly enabling thinning and a reduction in weight of the chain transmission system to be achieved and consequently enabling a reduction in weight of the engine to be achieved.

Moreover, since the high pressure fuel pump is disposed on the driven side of the chain transmission system, it is possible to dispose it on the camshaft side by making it sufficiently distant from the crankshaft toward the camshaft side, thus increasing the degree of freedom in layout of the high pressure fuel pump.

In accordance with the second aspect of the present invention, it is possible to minimize the amount of overhang of the camshaft from the engine main body and the amount of overhang of the pump input shaft from the pump support member, thus enabling durability to be achieved therefor.

In accordance with the third aspect of the present invention, a contribution can be made to making the engine compact.

EXPLANATION OF REFERENCE NUMERALS AND SYMBOLS

Figure 1:
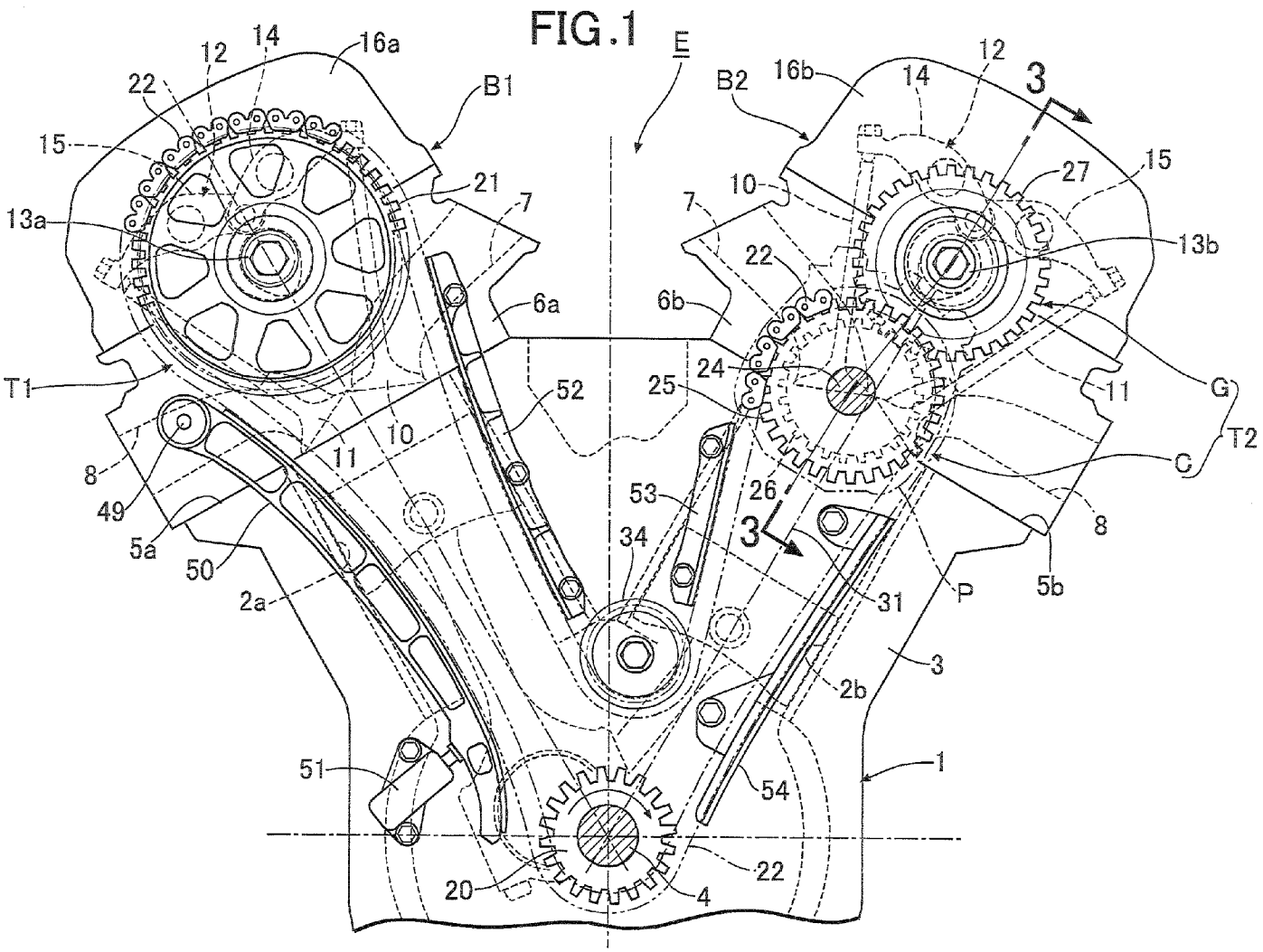
FIG. 1 is a front view of an automobile V-type engine equipped with the timing transmission mechanism of the present invention (first embodiment).

C Chain transmission system
E Engine
G Gear transmission system
P High pressure fuel pump
T2 Timing transmission mechanism (second timing transmission mechanism)
1 Engine main body
4 Crankshaft
13*b* Camshaft (second camshaft)
20 Drive sprocket
22 Chain
24 Pump input shaft
25 Driven sprocket (second driven sprocket)
Drive gear
27 Driven gear
30 Pump support member (transmission case)

BEST MODE FOR CARRYING OUT THE INVENTION

A mode for carrying out the present invention is explained below by reference to a preferred embodiment of the present invention shown in the attached drawings.

Embodiment 1

Figure 2:
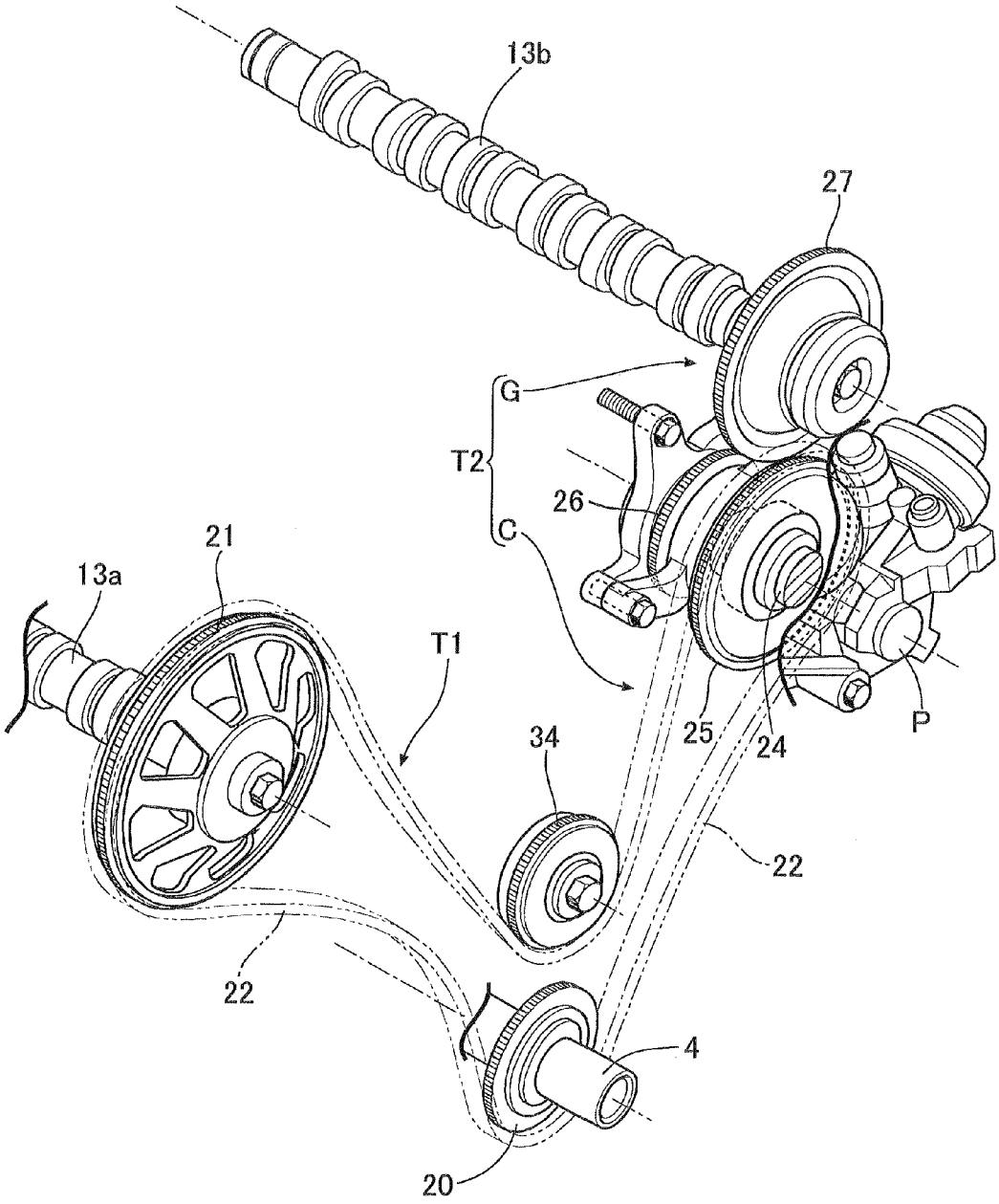
FIG. 2 is a perspective view of the timing transmission mechanism (first embodiment).

First, in FIG. 1 and FIG. 2, an engine E is a V-type engine having first and second banks B1 and B2 disposed on the left and right in a V-shape. A plurality of cylinders 2*a* and 2*b* possessed by the first and second banks B1 and B2 respectively are formed in a common cylinder block 3, and a crankshaft 4 is rotatably supported in a lower part of the cylinder block 3.

Formed in an upper part of the cylinder block 3 are first and second deck surfaces 5*a* and 5*b* on which the cylinders 2*a* and 2*b* of the first and second banks B1 and B2 open, and joined to the first and second deck surfaces 5*a* and 5*b* are cylinder heads 6*a* and 6*b* respectively. Formed in each of the cylinder heads 6*a* and 6*b* are an intake port 7 and an exhaust port 8 corresponding to each of the cylinders 2*a* and 2*b*, and provided therein are intake and exhaust valves 10 and 11 opening and closing these intake and exhaust ports 7 and 8, and a valve operating system 12 making these intake and exhaust valves 10 and 11 open and close.

This valve operating system 12 is formed from a camshaft 13*a*, 13*b* rotatably supported on the cylinder head 6*a*, 6*b* in parallel to the crankshaft 4, and intake and exhaust rocker arms 14 and 15 that change a lifting action of intake and exhaust cams of the camshaft 13*a*, 13*b* into a valve-opening action and transmit it to the intake and exhaust valves 10 and 11 respectively. A head cover 16*a*, 16*b* covering this valve operating system 12 is joined to an upper end face of the cylinder head 6*a*, 6*b*. In the above arrangement, an engine main body 1 is formed from the cylinder block 3 and the cylinder heads 6*a* and 6*b*. Hereinafter, the camshaft 13*a* on the first bank B1 side is called a first camshaft 13*a*, and the camshaft 13*b* on the second bank B2 side is called a second camshaft 13*b*.

End parts of the crankshaft 4, the first camshaft 13*a*, and the second camshaft 13*b* project toward one side of the engine main body 1; a first timing transmission mechanism T1 provides a connection between the end parts of the crankshaft 4 and the first camshaft 13*a*, and a second timing transmission mechanism T2 provides a connection between the end parts of the crankshaft 4 and the second camshaft 13*b*.

The first timing transmission mechanism T1 is formed from a drive sprocket 20 fixed to the end part of the crankshaft 4, a first driven sprocket 21 fixed to the end part of the first camshaft 13*a*, and a chain 22 wound around the drive sprocket 20 and the first driven sprocket 21, rotation of the crankshaft 4 being transmitted at a reduction ratio of 1/2.

On the other hand, the second timing transmission mechanism T2 is used also for driving a high pressure fuel pump P for injecting fuel directly into the cylinders 2*a* and 2*b* of the banks B1 and B2. This is explained in detail by reference to FIG. 1 to FIG. 3.

Figure 3:
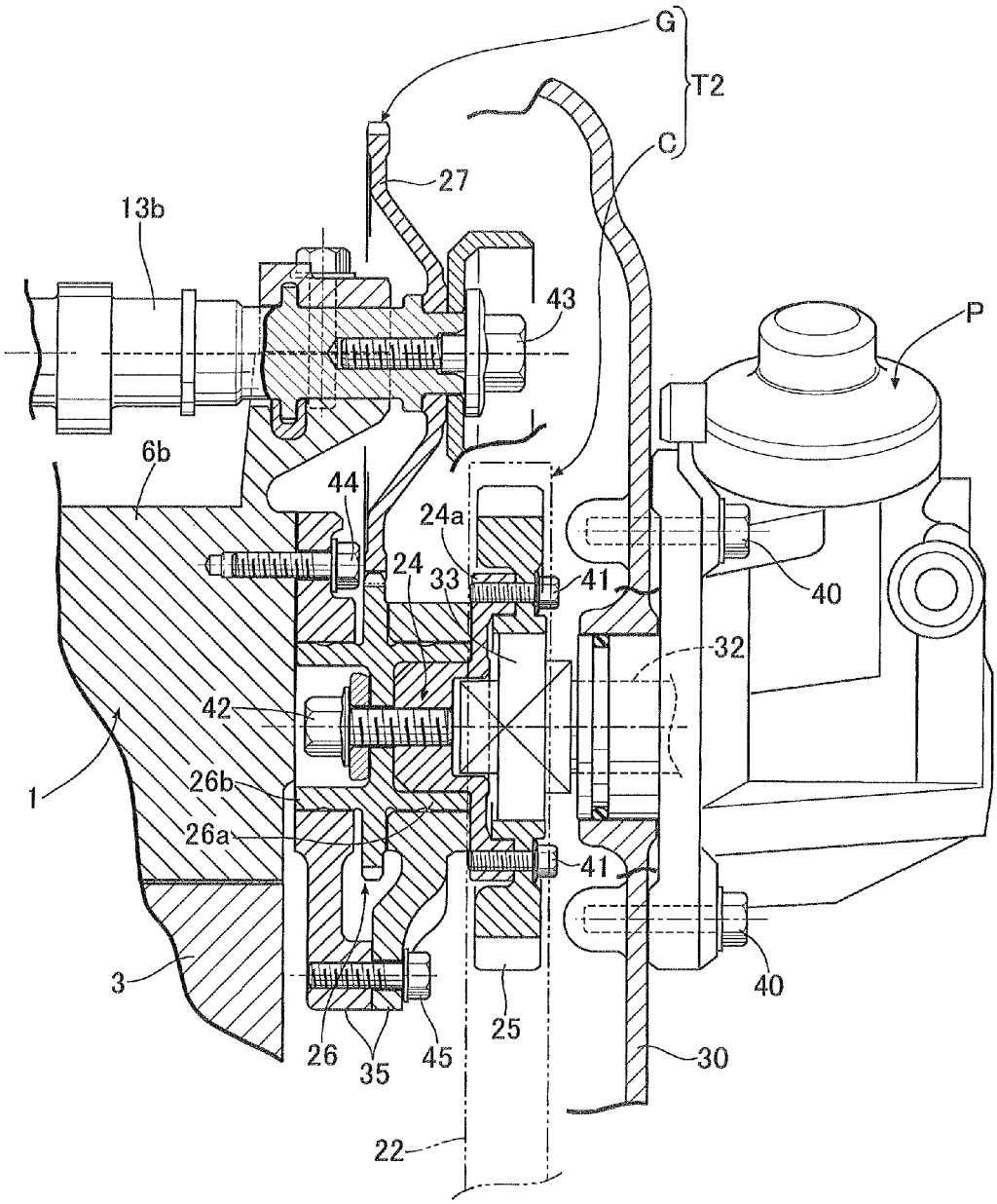
FIG. 3 is a sectional view along line 3-3 in FIG. 1 (first embodiment).

In FIG. 2 and FIG. 3, the high pressure fuel pump P is mounted by a bolt 40 on an outside face of a transmission cover 30 joined to the engine main body 1 so as to cover the first and second timing transmission mechanisms T1 and T2. In this arrangement, the high pressure fuel pump P is disposed so that as shown in FIG. 1 a pump input shaft 24 is closer to the second camshaft 13*b* than the midpoint between the crankshaft 4 and the second camshaft 13*b* and is offset toward the first bank B1 side relative to a plane 31 that connects the axes of the crankshaft 4 and the second camshaft 13*b*.

The high pressure fuel pump P has a rotor shaft 32 projecting toward the inside of the transmission cover 30 in parallel to the second camshaft 13*b*, and the pump input shaft 24 is connected to the rotor shaft 32 via a joint 33. As the joint 33, for example, an Oldham joint may be used.

A flange 24*a* is formed on an end part, on the joint 33 side, of the pump input shaft 24, and a second driven sprocket 25 surrounding the joint 33 is joined integrally to this flange 24*a* by a bolt 41. The chain 22 is wound around this second driven sprocket 25 and the drive sprocket 20. In the illustrated example, the chain 22 is used in common by the first and second timing transmission mechanisms T1 and T2, and a guide rotor 34 that regulates the upper path of the chain 22 from the first bank B1 side to the second bank B2 side is axially supported on the engine main body 1 directly above the crankshaft 4.

Referring again to FIG. 3, a drive gear 26 is integrally joined by a bolt 42 to an end face, on the opposite side to the second driven sprocket 25, of the pump input shaft 24, and this drive gear 26 meshes with a driven gear 27 integrally joined by a bolt 43 to the end part of the second camshaft 13*b*.

The drive gear 26 integrally has cylindrical first and second hubs 26*a* and 26*b* projecting from opposite side faces thereof, the first hub 26*a* being fitted around the outer periphery of the pump input shaft 24. These first and second hubs 26*a* and 26*b* are rotatably supported by a bifurcated bearing member 35 fixed to one side face of the engine main body 1 by a bolt 44. This bifurcated bearing member 35 is divided into two at an intermediate part in the axial direction, and the two portions are fitted onto the first and second hubs 26*a* and 26*b* and then joined to each other by a bolt 45. Therefore, the drive gear 26 is doubly supported by the bearing member 35.

A chain transmission system C formed of the drive sprocket 20, the second driven sprocket 25, and the chain 22 is thus formed, and a gear transmission system G formed of the drive gear 26 and the driven gear 27 is thus formed, the gear transmission system G being disposed inside the chain transmission system C, that is, between the chain transmission system C and the engine main body 1. The second timing transmission mechanism T2 is formed from the chain transmission system C and the gear transmission system G, rotation of the crankshaft 4 being transmitted to the pump input shaft 24 and rotation of the crankshaft 4 being transmitted to the second camshaft 13*b* at a reduction ratio of 1/2.

Referring again to FIG. 1, an upper end part of a movable chain guide 50 that is in sliding contact with the outside face, on the slack side, of the chain 22 between the drive sprocket 20 and the first driven sprocket 21 is swingably and axially supported on the engine main body 1 via a pivot shaft 49, and a chain tensioner 51 that presses a lower end part of this movable chain guide 50 toward the chain 22 side is mounted on the engine main body 1. Furthermore, fixed chain guides 52, 53, and 54 that are in sliding contact with the outside face of the chain 22 between the second driven sprocket 25 and the guide rotor 34, the outside face of the chain 22 between the guide rotor 34 and the second driven sprocket 25, and the outside face of the chain 22 between the second driven sprocket 25 and the drive sprocket 20 respectively are fixed to one side face of the engine main body 1.

The operation of this embodiment is now explained.

While the engine E is running, in the first timing transmission mechanism T1, rotation of the crankshaft 4 is reduced in speed at a reduction ratio of 1/2 and transmitted to the first camshaft 13*a*, thus rotatingly driving it.

On the other hand, in the second timing transmission mechanism T2, the chain transmission system C transmits rotation of the crankshaft 4 to the pump input shaft 24 of the high pressure fuel pump P and operates the high pressure fuel pump P, and by cooperation of the chain transmission system C and the gear transmission system G rotation of the crankshaft 4 is reduced in speed at a reduction ratio of 1/2 and transmitted to the first camshaft 13*a*, thus rotatingly driving it.

The load for the high pressure fuel pump P of the engine E is higher than the load for the second camshaft 13*b*; in the second timing transmission mechanism T2, as described above, since rotation of the crankshaft 4 is first transmitted to the high pressure fuel pump P via the chain transmission system C and then to the second camshaft 13*b* via the gear transmission system G, it is possible to prevent the load for the high pressure fuel pump P from being imposed on the second camshaft 13*b*, thus enabling thinning and a reduction in weight of the gear transmission system G and the second camshaft 13*b* to be achieved.

Moreover, since the gear transmission system G is formed from the double gear, that is, the drive gear 26 and the driven gear 27 mounted on the pump input shaft 24 and the second camshaft 13*b* respectively, not only is the number of components small and the structure simple, but it is also possible to minimize backlash occurring in the second timing transmission mechanism T2, thus maintaining appropriate transmission timing from the crankshaft 4 to the second camshaft 13*b*.

Furthermore, although the second camshaft 13*b* is subjected to variation in load due to the valve operating action thereof, since the variation in load is absorbed via the gear transmission system G by the high pressure fuel pump P, which has a high load, it is possible to prevent the variation in load for the second camshaft 13*b* from being imposed on the chain transmission system C, thus correspondingly enabling thinning and a reduction in weight of the chain transmission system C to be achieved and consequently enabling a reduction in weight of the engine E to be achieved.

Moreover, since the high pressure fuel pump P is disposed on the driven side of the chain transmission system C, it is possible to dispose it on the second camshaft 13*b* side by making it sufficiently distant from the crankshaft 4 and, specifically, to dispose it on the second camshaft 13*b* side relative to the midpoint between the crankshaft 4 and the second camshaft 13*b*, thus increasing the degree of freedom in layout of the high pressure fuel pump P. In this arrangement, disposing the high pressure fuel pump P so that it is offset toward the first bank B1 side from the plane 31 passing through the axes of both the crankshaft 4 and the second camshaft 13*b* is effective in making the V-type engine E compact.

Furthermore, since the high pressure fuel pump P is mounted on the transmission cover 30 covering the second timing transmission mechanism T2, and the gear transmission system G is disposed between the engine main body 1 and the chain transmission system C, it is possible to minimize the amount of overhang of the second camshaft 13*b* from the engine main body 1 and the amount of overhang of the pump input shaft 24 from the transmission cover 30, thus enabling durability to be achieved therefor.

In the engine E of this embodiment, since the second camshaft 13*b* and the high pressure fuel pump P are disposed in extremely close proximity to each other, if, depending on the type of equipment, the high pressure fuel pump P is not required, means for driving the second camshaft 13*b* can be simply modified so that the second camshaft 13*b* is driven via the chain 22, a plurality of types of equipment can be simply dealt with without any modification to the engine main body 1, and the cost merit is high.

The present invention is not limited to the above-mentioned embodiment and may be modified in a variety of ways as long as the modifications do not depart from the spirit and scope thereof. For example, the present invention is not limited to a V-type engine and can be applied to an in-line multicylinder engine.

The invention claimed is:

1. A timing transmission mechanism in an engine, the timing transmission mechanism being for driving, by means of a crankshaft (4), a valve operating camshaft (13*b*) with predetermined timing and a high pressure fuel pump (P), characterized in that the timing transmission mechanism comprises a chain transmission system (C) formed from a drive sprocket (20) mounted on the crankshaft (4), a driven sprocket (25) mounted on a pump input shaft (24) of the high pressure fuel pump (P), which is disposed on one side of an engine main body (1) where the drive sprocket (20) is present, and a chain (22) wound around the drive sprocket (20) and the driven sprocket (25); and a gear transmission system (G) formed from a drive gear (26) mounted on the pump input shaft (24) coaxially with the driven sprocket (25) and a driven gear (27) mounted on the camshaft (13*b*) and meshing with the drive gear (26).

2. timing transmission mechanism in an engine according to claim 1, wherein the chain transmission system (C) and the gear transmission system (G) are both disposed on one side of the engine main body (1), which supports the crankshaft (4) and the camshaft (13*b*), the gear transmission system (G) is disposed between the engine main body (1) and the chain transmission system (C), and the high pressure fuel pump (P) is mounted on a pump support member (30) that is fixed to the engine main body (1) so as to be adjacent to an outside face of the chain transmission system (C).

3. timing transmission mechanism in an engine according to claim 1 or 2, wherein the high pressure fuel pump (P) is disposed offset toward one side of a plane that connects axes of the crankshaft (4) and the camshaft (13*b*).

* * * * *